US005855697A

United States Patent [19]

Luo et al.

[11] Patent Number: 5,855,697

[45] Date of Patent: Jan. 5, 1999

[54] MAGNESIUM ALLOY HAVING SUPERIOR ELEVATED-TEMPERATURE PROPERTIES AND DIE CASTABILITY

[75] Inventors: Aihua A. Luo, Ypsilanti; Toru Shinoda, Ann Arbor, both of Mich.

[73] Assignee: Imra America, Inc., Ann Arbor, Mich.

[21] Appl. No.: 861,056

[22] Filed: May 21, 1997

[51] Int. Cl.[6] ..... C22C 23/00

[52] U.S. Cl. ..... 148/420; 420/407; 420/408; 420/409; 420/411

[58] Field of Search ..... 148/420; 420/402, 420/407, 408, 409, 411

[56] References Cited

U.S. PATENT DOCUMENTS 5,304,260 4/1994 Aikawa et al. ..... 148/420

FOREIGN PATENT DOCUMENTS 06200348 7/1994 Japan .

06316751 11/1994 Japan .

*Primary Examiner*—Sikyin Ip

*Attorney, Agent, or Firm*—Burns, Doane, Swecker & Mathis, LLP

[57] ABSTRACT

A magnesium based alloy exhibiting superior elevated-temperature properties such as creep resistance and tensile strength and die castability such as reduced hot-cracking and die-sticking, contains about 2 to 9 wt. % aluminum, 6 to 12 wt. % zinc, 0.1 to 2.0 wt. % calcium, optionally 0.2 to 0.5 wt. % manganese, and the balance comprising magnesium. The alloy includes the intermetallic compound Mg—Al—Zn—Ca at the grain boundaries of the magnesium crystals. The alloy according to this invention may have a creep extension of less than about 0.6% at the tensile stress of about 35 MPa and the temperature of about 150° C., and a tensile yield strength of at least 110 MPa at the temperature of about 150° C. The alloy is particularly useful in die casting applications.

21 Claims, 5 Drawing Sheets

MAGNESIUM ALLOY HAVING SUPERIOR ELEVATED-TEMPERATURE PROPERTIES AND DIE CASTABILITY

BACKGROUND OF THE INVENTION

1. Field of the Invention

This invention relates to a magnesium based alloy. In particular, the invention relates to a magnesium alloy having superior mechanical properties at elevated temperatures. The alloy of this invention has excellent castability, and is particularly useful in die casting applications.

2. Description of Prior Art

The low density of magnesium, approximately ⅔ that of aluminum and ¼ that of steel, makes it particularly attractive for transportation applications where weight reduction is critical. Magnesium is also surprisingly strong for a light metal; in fact, it has the best strength-to-weight ratio of any commonly available cast metal. In addition, magnesium can offer many other advantages such as good damping capacity, superior castability, excellent machinability, and good corrosion resistance. The use of magnesium alloy parts in automobiles has experienced a rapid growth in recent years due to the ever-increasing demand of vehicle weight reduction.

Magnesium alloy parts can be fabricated by the conventional casting processes including die casting, sand casting, plaster casting, permanent mold casting and investment casting.

Various alloys have been developed for use in particular applications including, for example, the die casting of parts for automobiles. Among these alloys, magnesium-aluminum based alloys, for instance AM50A and AM60B alloys ("AM" designates aluminum and manganese additions) containing about 5 to 6 wt. % of aluminum and a trace amount of manganese; and magnesium-aluminum-zinc based alloys, for instance AZ91D ("AZ" designates aluminum and zinc additions) containing about 9 wt. % of aluminum and about 1 wt. % of zinc, are economically priced and widely used in the fabrication of automobile parts. One disadvantage of these alloys is that they have low strength and poor creep resistance at elevated operating temperatures. This makes the above magnesium alloys unattractive for applications in the automotive powertrains where the components such as transmission cases will experience temperatures up to 150° C. in the operating life. The poor creep strength of such components can lead to the reduction of fastener clamp load in bolted joints and, subsequently, to oil leakage in powertrains.

Another magnesium alloy which does provide some improved creep resistance is designated AE42 ("AE" designates aluminum and rare earth metal additions). This alloy comprises about 4 wt. % of aluminum and about 2 wt. % of rare earth elements. However, due to the use of rare earth elements, this alloy is difficult to die cast and uneconomical for volume production of automobile components.

Other magnesium alloys with good elevated-temperature properties have been developed over the years. These alloys can be classified into two groups. The first group of alloys contain exotic and expensive elements such as silver, yttrium, rare earth, and zirconium, and they are primarily developed for gravity sand casting and use in aerospace and nuclear reactors. The second group consists of a number of experimental alloys as disclosed in U.S. Pat. Nos. 4,997,662; 5,078,962; and 5,147,603. These alloys were developed for rapid solidification processes such as melt-spinning or spray deposition in which the extremely high solidification rates ($10^4$ to $10^7$ K/sec.) can be achieved. Due to the high solidification rates, additions of certain alloying elements such as calcium or strontium can be made very high—up to 7 wt. %—contributing to the extremely high strength of these alloys at elevated temperatures. Unfortunately, the creep resistance of the alloys is poor because of the extremely fine grain structure in rapid solidification processed alloys. Another drawback of this group of alloys is that the process is not feasible for fabricating large components and is too costly for commercial production. None of alloys from the aforementioned groups is suitable for commercial die casting of automobile components.

The potential of adding calcium to magnesium-aluminum based die casting alloys for improved creep resistance has been investigated. British Patent No. 847,992 discloses that calcium additions from 0.5 to 3 wt. % can bring about high creep resistance to magnesium based alloys comprising up to 10 wt. % of aluminum, up to 0.5 wt. % of manganese and a possible zinc content of up to 4 wt. %. PCT/CA96/00091 discloses that magnesium based alloys containing 2 to 6 wt. % of aluminum and 0.1 to 0.8 wt. % of calcium show superior creep resistance at 150° C. However, both documents acknowledge that alloys with high calcium contents are prone to hot-cracking during die casting. The British patent states that such hot-cracking tendency can be suppressed with considerable certainty or at least reduced to a fully satisfactory extent by ensuring that the iron content of the alloys is not less than 0.01 wt. % and preferably between 0.015 and 0.03 wt. %. However, it is now well known that such a high iron content will cause severe corrosion problems, as the tolerance limit for iron content in modern high-purity and corrosion-resistant magnesium alloys is 0.004 wt. %, as required by ASTM (American Society for Testing and Materials) Specification B93/B93M-94b. The PCT publication confirms that the use of calcium more than 0.8 wt. % adversely affects the die castability of the alloy due to extensive hot-cracking and die-sticking (also known as "die-soldering").

A third publication, entitled "Magnesium in the Volkswagen" by F. Hollrigl-Rosta, E. Just, J. Kohler and H. J. Melzer (Light Metal Age, 22–29, August 1980), discloses that outstanding improvement of creep resistance was provided by addition of about 1 wt. % calcium to a magnesium alloy AZ81 which contains about 8 wt. % of aluminum and about 1 wt. % of zinc. However, this publication discloses that the application of this alloy to the die casting production of crankcases (automotive parts) was not possible, because the castings stuck in the die and hot cracks occurred.

It is clear from the above three documents that the potential of improved creep resistance in magnesium alloys by calcium has not been fully realized due to the degraded castability associated with the calcium additions. Accordingly, there is a need in the art for economical magnesium alloys which exhibit improved castability while providing adequate creep strength.

SUMMARY OF THE INVENTION

The present invention has been developed in order to solve the aforementioned problems of magnesium alloys. It is therefore a primary object of the present invention to provide a magnesium alloy with superior creep-resistance and tensile strength at elevated temperatures up to 150° C. (better than or equal to those of AE42 alloy). It is a further object of the present invention to provide a magnesium alloy with improved tensile strength at room temperature (better than or equal to that of AZ91D alloy). It is yet another object of the present invention to provide a magnesium alloy which can be used to fabricate automotive components, which enables mass production by die casting, and which is available at low costs. In particular, it is another object of the present invention to provide a magnesium alloy whose castability is enhanced while maintaining the creep resistance and high-temperature strength as good as those of the AE42 alloy. In addition, it is a still further object of the present invention to provide a magnesium alloy whose corrosion resistance is equivalent to those of AZ91D alloy.

The present invention provides a magnesium alloy comprising from about 2 to about 9 wt. % of aluminum, from about 6 to about 12 wt. % of zinc, and from about 0.1 to about 2 wt. % of calcium. The alloy has superior creep and tensile properties at a temperature of up to 150° C., good castability and low costs.

Preferably, the amount of aluminum varies from about 3 to about 7 wt. %. The amount of zinc present in the alloy preferably varies from about 6 to about 10 wt. %. In addition, the preferable range of calcium content in the alloy is from about 0.4 to about 1.5 wt. %.

As described in the foregoing, the main constituent elements of the alloy are magnesium, aluminum, zinc and calcium. The alloy may also contain other elements, such as from about 0.2 to about 0.5 wt. % of manganese, and up to about 0.05 wt. % of silicon; and impurities, such as less than about 0.004 wt. % of iron, less than about 0.001 wt. % of nickel, and less than about 0.008 wt. % of copper.

It has surprisingly been found that the addition of the specified amounts of aluminum, zinc and calcium according to the present invention results in the formation of a Mg—Al—Zn—Ca intermetallic compound at the grain boundaries of the magnesium. Without being limited by theory, it is believed that the Mg—Al—Zn—Ca intermetallic phase results in high metallurgical stability and strengthens the boundaries of the magnesium grains in the alloy at room and elevated temperatures.

Preferably, the alloy comprises from about 5 to about 30 volume % of the intermetallic phase, more preferably from about 15 to about 25 volume %.

The alloy according to this invention may have a creep extension of less than about 0.6 % at a tensile stress of about 35 MPa and a temperature of about 150° C., as measured by ASTM Specification E139-95, and a yield strength of at least about 110 MPa at a temperature of about 150° C., as measured by ASTM Specification E21-92. The alloy is particularly useful as a die casting alloy due to its high zinc content which results in improved castability (decreased hot-cracking and die-sticking). The alloy of this invention also has good corrosion resistance (as measured by ASTM Specification B117-95) and is available at low costs.

DESCRIPTION OF PREFERRED EMBODIMENTS

Figure 1:
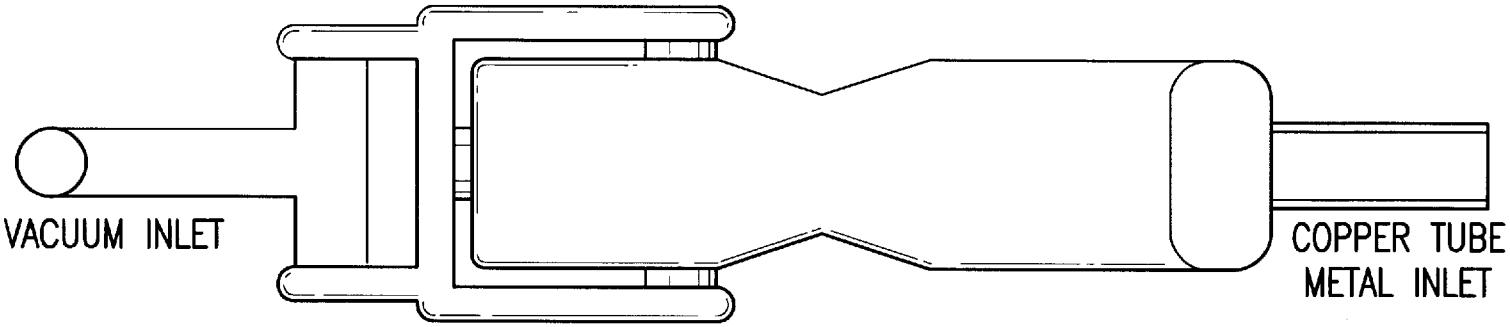
FIG. 1 is drawing of a specimen used for obtaining hot-cracking test data for alloys in accordance with the invention.

The invention provides a die castable magnesium based alloy having improved properties at elevated temperatures yet enables economical and reproducible mass production of die cast parts using readily available and low cost alloy ingredients. According to one embodiment, the alloy includes additions in amounts which achieve improved creep strength and die castability.

The alloy of this invention preferably comprises zinc, aluminum and calcium in a magnesium base alloy. The compositional ranges of such additions in the present magnesium alloy provide the following advantages.

(a) Aluminum

Aluminum is a well-known alloying element in magnesium based alloys as it contributes to the room-temperature strength and castability of the alloys. In order to obtain these advantageous effects, a minimum of 2 wt. %, and preferably at least 4 wt. % of aluminum should be included in the alloy according to the present invention. However, it is also known that aluminum has adverse effects on the creep resistance and tensile strength of magnesium alloys at elevated temperatures. This is because aluminum tends to, when its content is high, combine with the magnesium to form significant amounts of the intermetallic compound $Mg_{17}Al_{12}$, which has a low melting point (437° C.) and therefore is deleterious to the high-temperature properties of magnesium based alloys. Accordingly, a preferred upper limit of the aluminum range is set at 9% by weight. A more preferred upper limit of aluminum is 7% by weight to achieve improvement in elevated temperature properties such as creep resistance and tensile strength.

(b) Calcium

Among the elements which have been found to improve the high-temperature strength and creep resistance of magnesium alloys, calcium is the most economical (in comparison with silver, yttrium and various rare earth elements). It is therefore necessary to include calcium in an amount of 0.2% by weight or more. However, when calcium is included in a magnesium-aluminum based alloy, the castability of the alloy is severely deteriorated to the extent that the alloy is no longer castable by the conventional die casting process. In the present invention, it has surprisingly and unexpectedly been found that the castability of the magnesium-aluminum-calcium alloy can be restored by the addition of a suitable amount zinc such as from about 6 to about 12 wt. %, more preferably from about 6 to about 10 wt. %. Based on this important discovery, in the presence of zinc, calcium can be added in amounts up to 2 wt. %, preferably up to 1.5 wt. %, in order for the alloy to achieve the maximum creep resistance while maintaining good die-castability.

(c) Zinc

Zinc improves the room-temperature strength and castability of magnesium alloys, and up to 1 wt. % of zinc is commonly included in magnesium casting alloys such as the AZ91D. In the present invention, a considerably higher zinc range, i.e., from about 6 to about 12 wt. %, more preferably, about 6 to about 10 wt. %, is chosen based on two reasons: Firstly, as the aluminum content in the alloy is relatively low in order to achieve good high-temperature strength and creep resistance, high zinc contents are used as a supplement to enhance the room-temperature strength and castability of the alloy. Secondly, and more importantly, zinc surprisingly and unexpectedly restores the die-castability of magnesium alloys containing up to about 2 wt. % of calcium. The upper limit of the zinc range is set at about 12 wt. %, more preferably, about 10 wt. % so that the density of the alloy remains low.

A further understanding of the alloy design in the present invention can be obtained from the following study on the effects of calcium and zinc contents on the castability of magnesium-aluminum based alloys. The die-castability was evaluated in terms of hot-cracking and die-sticking tendencies. For hot-cracking evaluation, a vacuum die casting system was used to cast specimens as shown in FIG. 1. A reduced section in the middle of the specimens was designed to create stress which would induce different levels of hot-cracking during the solidification shrinkage, depending on the castability of the alloy. The total length of cracks on both surfaces of each specimen was measured for hot-cracking tendency. Die-sticking tendency of the alloys was rated 0 to 5 ("0" representing "no die-sticking" and "5" representing "most die-sticking") during the casting test using a steel die with no coating or spray, based on the ease of casting ejection, die cleaning and surface quality of the specimens.

Figure 2:
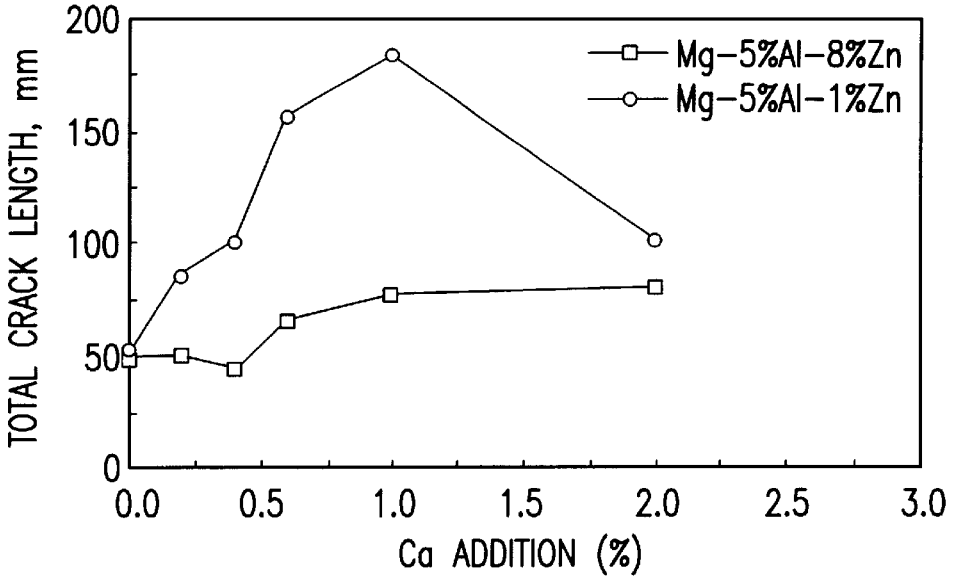
FIG. 2 is a graph showing the effects of calcium and zinc contents on the hot-cracking tendency of a magnesium-5 wt. % aluminum alloy.

FIG. 2 shows the effect of calcium additions on the hot-cracking tendency of magnesium-aluminum based alloys (Mg-5%Al) containing two levels of zinc. It is evident that, when zinc is low, for example, at about 1 wt. %, the total crack length of the alloy increases dramatically with calcium contents up to about 1 wt. %, and then gradually decreases. However, when zinc is high, for instance, at about 8 wt. %, the effect of calcium on the total crack length of the alloy is minimal up to 2 wt. % of calcium addition.

Figure 3:
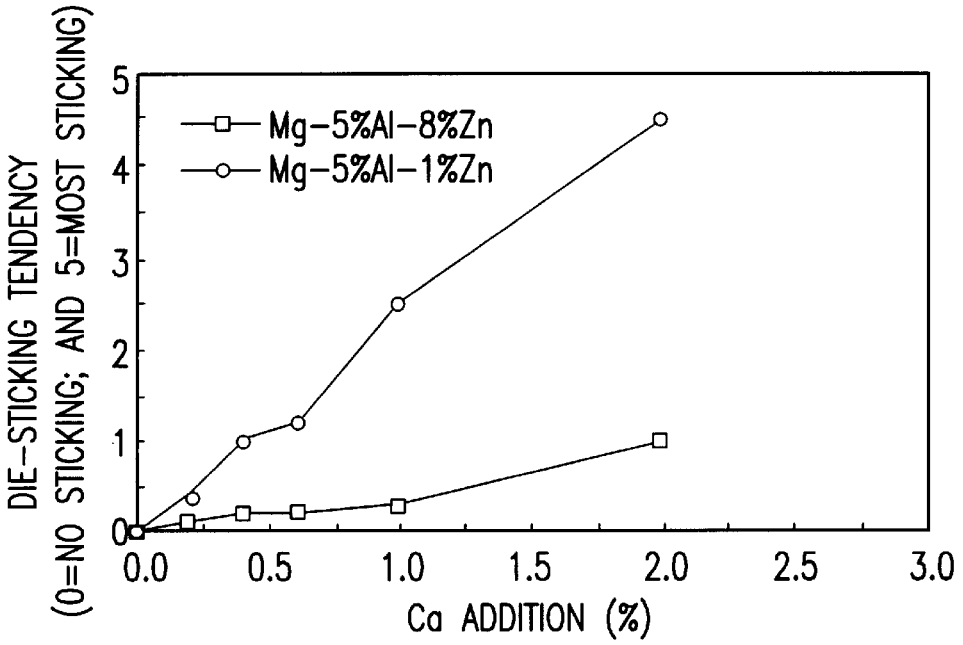
FIG. 3 is a graph showing the effects of calcium and zinc contents on the die-sticking tendency of a magnesium-5 wt. % aluminum alloy.

The effects of calcium content on the die-sticking tendency of the same magnesium-aluminum based alloys are illustrated in FIG. 3. For a Mg-5%Al alloy containing about 1 wt. % of zinc, the die-sticking tendency increases significantly with calcium addition, especially when the addition is over about 0.6 wt. %. On the other hand, a high zinc content of about 8 wt. % can effectively reduce such tendency of the alloy for calcium additions up to about 2 wt. %.

These important findings form the alloy design basis for the present invention: high zinc contents which accommodate the maximum calcium addition for the optimum high temperature properties at no cost to the die-castability.

The magnesium alloy in accordance with the present invention may also include lesser amounts of other additives and impurities. For example, from about 0.2 to about 0.5 wt. % of manganese can be added to the alloy to improve corrosion resistance. Silicon is a typical impurity element contained in the commercially pure magnesium ingots which are used to prepare magnesium alloys. The alloy of this invention may contain up to 0.05 wt. % of silicon which has no harmful effects on the properties.

Iron, nickel and copper are impurities which have deleterious effects on the corrosion resistance of magnesium alloys. Therefore, the alloy preferably contains less than about 0.004 wt. % of iron, less than about 0.001 wt. % of nickel, and less than about 0.008 wt. % of copper.

Figure 4:
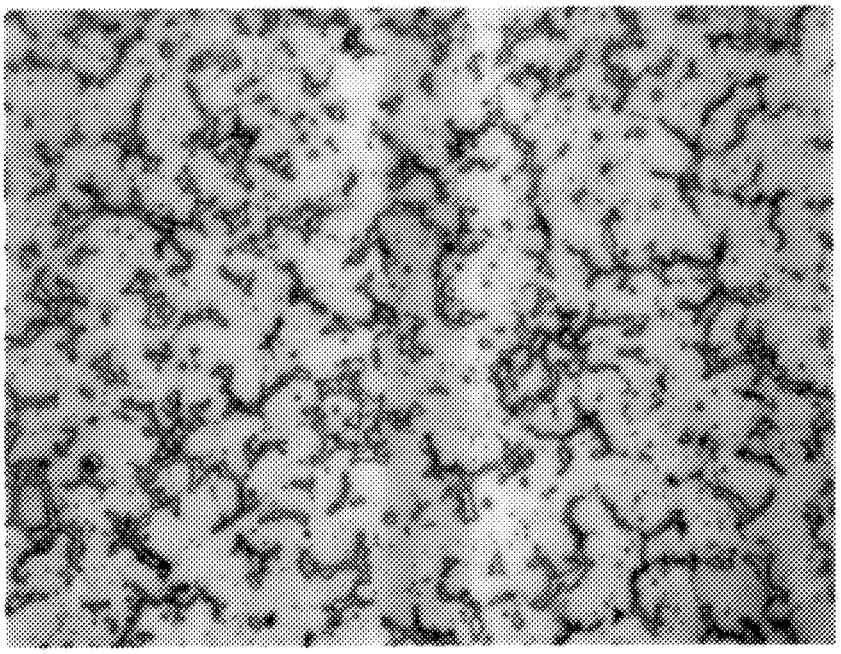
FIG. 4 is an optical micrograph (magnification: 1000×) showing the as-cast microstructure of a magnesium alloy prepared according to the present invention.
Figure 5:
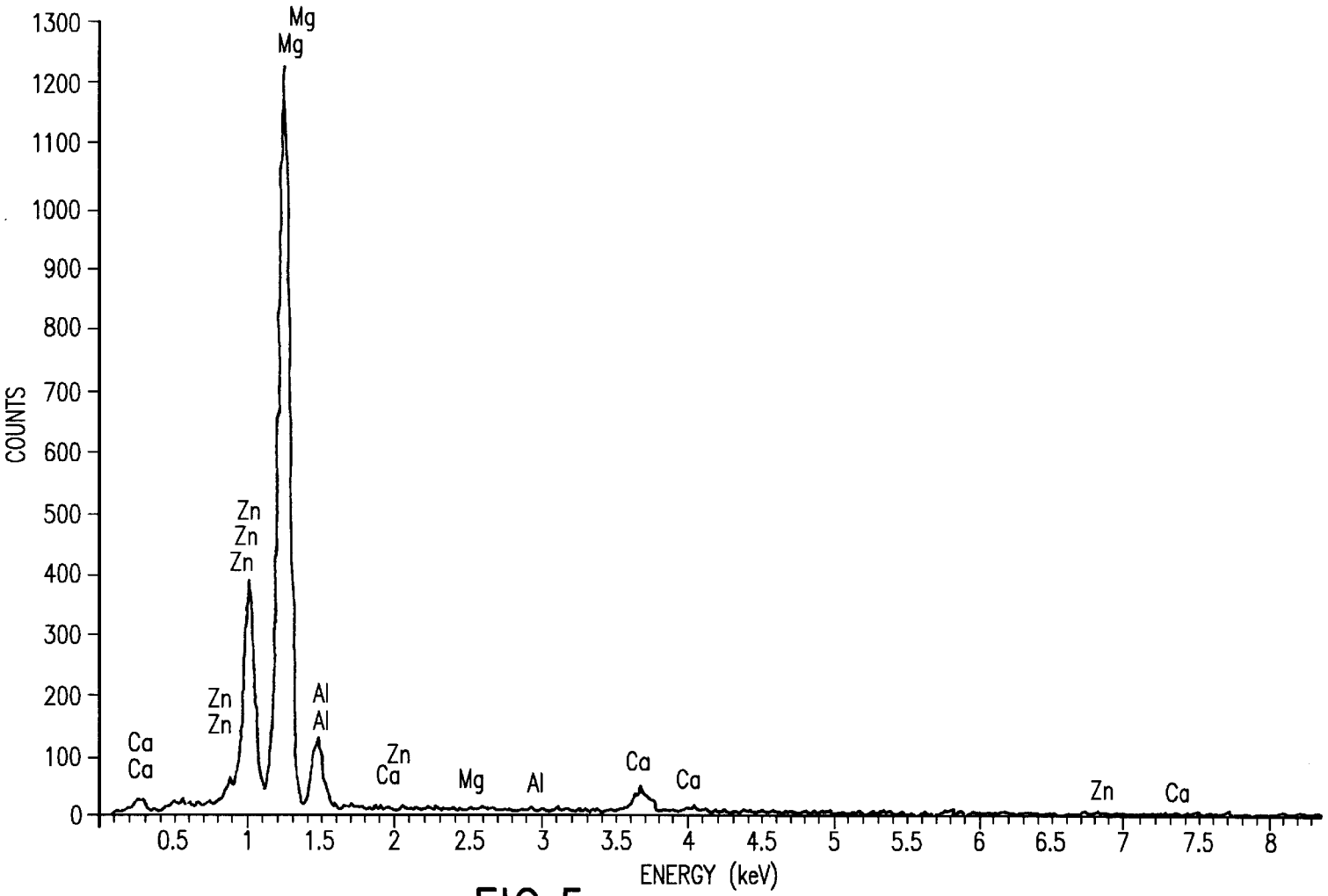
FIG. 5 is a printout of EDS (Energy Dispersive Spectroscopy) results showing that the alloys according to the invention include an intermetallic compound containing aluminum, magnesium, zinc and calcium.

It has surprisingly been found that the addition of aluminum, zinc and calcium as specified in this invention results in the precipitation of a Mg—Al—Zn—Ca intermetallic phase. This phase is generally positioned along the grain boundaries of the primary magnesium crystals in the alloy, as shown in FIG. 4. FIG. 5 is the EDS (energy dispersive spectroscopy) analysis results for the intermetallic phase, which clearly shows that the compound contains aluminum, magnesium, zinc and calcium. The intermetallic phase can have a nominal stoichiometry of $Mg_wAl_xZn_yCa_z$ wherein w=20 to 40 atomic %, x=15 to 25 atomic %, y=15 to 30 atomic %, and z=2 to 20 atomic %.

The magnesium based alloy of this invention has good creep resistance and high tensile strength at temperatures up to about 150° C. The alloy preferably has a 200-hour creep extension of less than about 0.6% at 35 MPa and 150° C., more preferably less than about 0.3% under such test conditions. The yield strength of the alloy at about 150° C. is preferably higher than about 110 MPa, more preferably higher than about 115 MPa. At the same test temperature (about 150° C.), the alloy of the invention preferably has an ultimate tensile strength greater than 150 MPa, more preferably greater than 160 MPa. It is understood that the excellent high-temperature creep and tensile properties of the alloy result from the strengthening effect of the Mg—Al—Zn—Ca intermetallic phase in the alloy. Preferably, the alloy according to this invention contains from about 5 to about 30 volume % of the intermetallic phase, more preferably from about 15 to about 25 volume %.

The alloy according to this invention has good yield and tensile strengths at room temperature, as measured by ASTM Specification E8-96. At ambient temperature, the alloy preferably has a yield strength of at least about 145 MPa and an ultimate tensile strength of at least about 200 MPa, more preferably not less than about 150 MPa for the yield strength and not less than 210 MPa for the ultimate tensile strength. The 200-hour salt spray corrosion rate of the alloy of this invention, as measured by ASTM Specification B117-95, is preferably less than about 0.25 $mg/cm^2/day$, more preferably less than about 0.16 $mg/cm^2/day$.

The alloy of this invention has very good castability as evaluated by hot-cracking and die-sticking tendencies during casting. The alloy is particularly tailored as a die casting alloy for mass production of automotive powertrain components. The alloy may also be used to fabricate components by any other standard casting processes including gravity and pressure casting such as die casting in a hot or cold chamber die casting machine. Alternatively, components can be fabricated from the alloy by other techniques including powder metallurgical and semi-solid processing techniques. The production of the alloy of this invention can be performed by any standard alloy production process using standard melting and alloying equipment for magnesium. The alloy according to this invention preferably does not contain any expensive ingredients so as to be economical for commercial production.

The invention can be further understood by the following example which is provided for purposes of illustration only and is not intended to limit the scope of the invention.

EXAMPLE 1

Magnesium based alloys having the following chemical compositions as set in Table 1 (wherein the balance of each alloy is Mg and unavoidable impurities) below were prepared using an electric resistance melting technique. The alloys, designated as ZAC8502, ZAC8506 and ZAC8512, respectively, were melted and cast into test specimens using a 200-ton hot-chamber die casting machine at a casting temperature of 650° C. At least 200 sets of specimens, i.e., 200 shots of die cast parts, were made for testing and evaluation.

TABLE 1

CHEMICAL COMPOSITION OF MAGNESIUM BASED ALLOYS (IN WT. %)

| Alloy | Al | Zn | Ca | Mn | Fe | Ni | Cu |
|---|---|---|---|---|---|---|---|
| ZAC8502 | 4.57 | 8.15 | 0.23 | 0.25 | 0.0021 | 0.0008 | 0.0001 |
| ZAC8506 | 4.74 | 8.12 | 0.59 | 0.25 | 0.0020 | 0.0013 | 0.0033 |
| ZAC8512 | 4.67 | 8.12 | 1.17 | 0.27 | 0.0022 | 0.0012 | 0.0033 |

The resulting test specimens were subjected to creep testing at 150° C. and 35 MPa (tensile stress) for 200 hours, and tensile testing at room temperature and 150° C. Creep testing was performed according to ASTM Specification E139-95, and the total creep extension was measured at 200 hours. The creep test results in comparison with other magnesium based alloys, namely AZ91D and AE42, are illustrated in FIG. 6.

Figure 6:
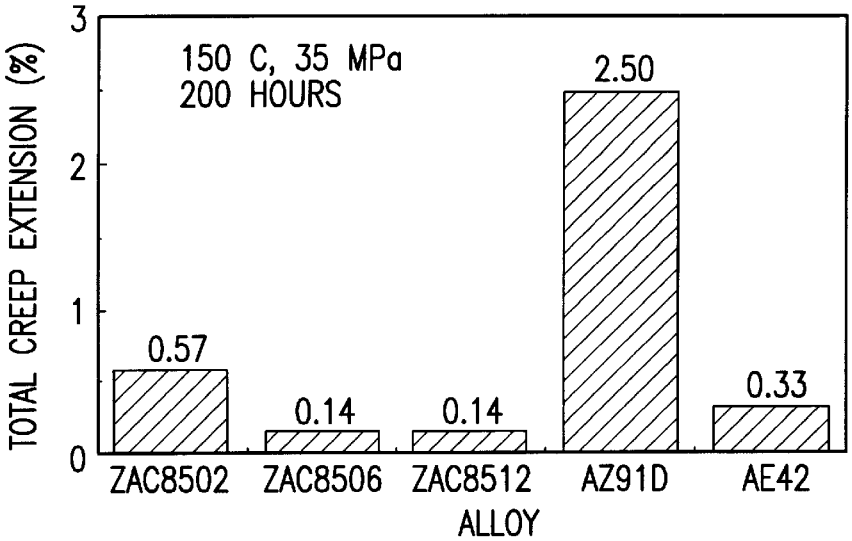
FIG. 6 is a graph showing creep test results for various Mg-based alloys.

FIG. 6 shows that the creep extension of the alloys prepared according to the present invention, i.e., ZAC8502, ZAC8506 and ZAC8512, is approximately one order of magnitude less than that of standard magnesium based alloy AZ91D. The alloys of this invention have a creep extension comparable to, or better than (in the case of ZAC8506 and ZAC8512) that of AE42 alloy at 150° C.

Table 2 summarizes the tensile test results for these alloys at 150° C. measured by ASTM Specification E21-92.

TABLE 2

TENSILE PROPERTIES AT 150° C.

| Alloy | ZAC8502 | ZAC8506 | ZAC8512 | AZ91D | AE42 |
|---|---|---|---|---|---|
| 0.2% yield strength (MPa) | 120 | 117 | 118 | 110 | 107 |
| ultimate tensile strength (MPa) | 175 | 159 | 149 | 159 | 160 |
| elongation (%) | 11.5 | 10.5 | 5.1 | 6.7 | 36 |

The results demonstrate that the 150° C. yield strength of the alloys prepared according to this invention are higher than those of conventional magnesium alloys AZ91D and AE42 while the ultimate tensile strength of the alloys of this invention is comparable to that of AZ91D and AE42 alloys. The elongation of the alloys of this invention is higher than that of AZ91D alloy, but substantially lower than that of AE42 alloy.

The tensile properties of the alloys were measured at room temperature pursuant to ASTM Specification E8-96. The results are set out in Table 3.

TABLE 3

TENSILE PROPERTIES AT ROOM TEMPERATURE

| Alloy | ZAC8502 | ZAC8506 | ZAC8512 | AZ91D | AE42 |
|---|---|---|---|---|---|
| 0.2% yield strength (MPa) | 165 | 146 | 151 | 150 | 138 |

TABLE 3-continued

TENSILE PROPERTIES AT ROOM TEMPERATURE

| Alloy | ZAC8502 | ZAC8506 | ZAC8512 | AZ91D | AE42 |
|---|---|---|---|---|---|
| ultimate tensile strength (MPa) | 230 | 219 | 206 | 230 | 220 |
| elongation (%) | 3 | 5 | 3 | 3 | 9 |

It can be seen from Table 3 that the alloys of this invention have equivalent or slightly better yield strength, ultimate tensile strength and elongation at room temperature when compared with magnesium alloy AZ91D. Table 3 further shows that the yield strength and ultimate tensile strength of the alloys according to the invention compare favorably with those of magnesium alloy AE42. However, the ductility (elongation) of the alloy is lower than that of the AE42 alloy.

Figure 7:
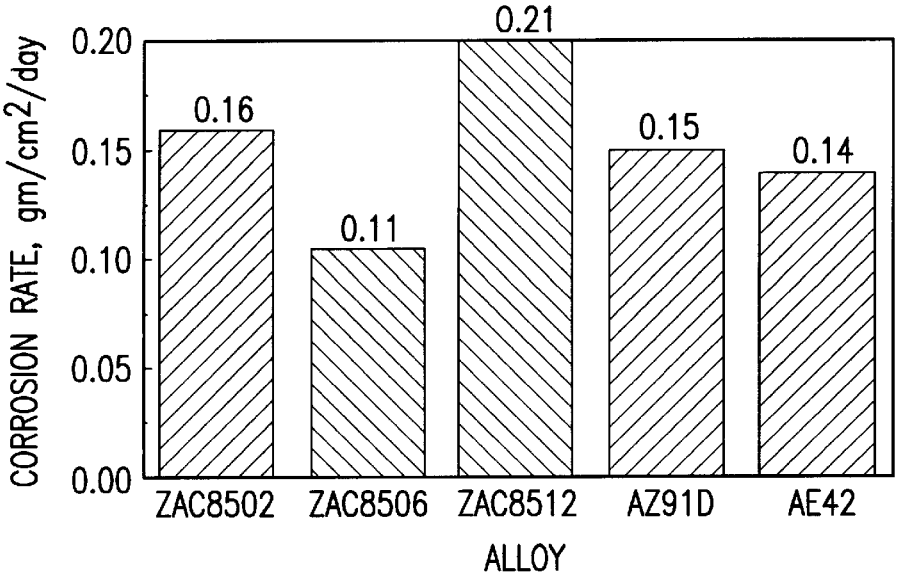
FIG. 7 is a graph showing the salt spray corrosion test results for various Mg-based alloys.

The alloys of this invention were also tested for salt spray corrosion performance according to ASTM Specification B117-95. The 200-hour corrosion rates for the alloys in comparison with those of AZ91D and AE42 alloys are shown in FIG. 7. As illustrated in FIG. 7, the alloys of this invention have similar corrosion resistance as other magnesium based alloys AZ91D and AE42.

Figure 8:
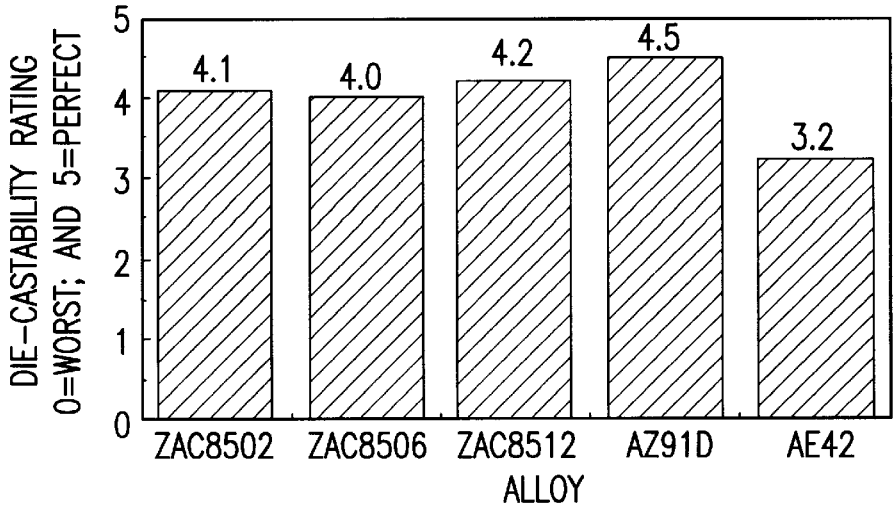
FIG. 8 is a graph showing the die-castability ratings for various Mg-based alloys.

The die-castability of the alloys was evaluated on a comparison basis. Each of the 200 die casting shots for each alloy was inspected for die-sticking and hot-cracking, and an overall rating of 0 to 5 ("0" representing "worst" and "5" representing "perfect") was given to each shot. FIG. 8 summarizes the average die-castability ratings for the alloys tested. The results suggest that the die-castability rating for the alloys of this invention is slightly lower than that of the AZ91D alloy (which is generally regarded as the "most die-castable" magnesium alloy) but significantly higher than that of the AE42 alloy.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

Whit is claimed is:

1. A cast magnesium based alloy having improved properties at elevated temperatures and enhanced castability, the alloy consisting essentially of, in wt. %, about 2 to about 9% aluminum, about 6 to about 12% zinc, about 0.1 to about 2% calcium, balance magnesium.

2. The magnesium based alloy of claim 1, wherein the alloy includes about 3 to about 7% Al, about 6 to about 10% Zn and about 0.4 to about 1.5% Ca.

3. The magnesium based alloy of claim 1, further comprising about 0.2 to about 0.5% Mn.

4. The magnesium based alloy of claim 1, further comprising up to about 0.05% Si.

5. The magnesium based alloy of claim 1, further comprising up to about 0.004% Fe.

6. The magnesium based alloy of claim 1, further comprising up to about 0.001% Ni.

7. The magnesium based alloy of claim 1, further comprising up to about 0.008% Cu.

8. The magnesium based alloy of claim 1, wherein the alloy includes precipitates of an intermetallic compound of Mg—Al—Zn—Ca.

9. The magnesium based alloy of claim 8, wherein the alloy includes about 5 to about 30 volume % of the precipitates.

10. The magnesium based alloy of claim 8, wherein the alloy includes about 15 to about 25 volume % of the precipitates.

11. The magnesium based alloy of claim 1, wherein the alloy is Si-free.

12. The magnesium based alloy of claim 1, wherein the alloy, as cast, exhibits elevated temperature properties at 150° C. of at least 110 MPa yield strength and a creep extension of less than about 0.6% after 200 hours at 150° C. and under a tensile stress of about 35 MPa.

13. The magnesium based alloy of claim 1, wherein the alloy comprises a die cast part.

14. The magnesium based alloy of claim 1, wherein the alloy is free of particles of $Mg_{17}Al_{12}$.

15. The magnesium based alloy of claim 1, wherein the calcium is effective to improve high-temperature strength and creep resistance and the zinc is effective to offset degradation of die castability due to the calcium content.

16. The magnesium based alloy of claim 1, formed into a shaped part by semi-solid die casting or gravity casting.

17. The magnesium based alloy of claim 1, consisting essentially of 3 to 6% Al, 7 to 10% Zn, 0.1 to 0.4% Ca, optionally 0.1 to 0.5% Mn, balance Mg.

18. The magnesium based alloy of claim 1, consisting essentially of 3 to 6% Al, 7 to 10% Zn, 0.4 to 0.8% Ca, optionally 0.1 to 0.5% Mn, balance Mg.

19. The magnesium based alloy of claim 1, wherein the alloy is free of rare earth metal.

20. A cast magnesium based alloy having improved properties at elevated temperatures, the alloy consisting essentially of Al, Zn, Ca and Mg, the alloy including grains of primary magnesium crystals and precipitates of $Mg_wAl_xZn_yCa_z$ wherein w=20 to 40 atomic %, x=15 to 25 atomic %, y=15 to 30 atomic % and z=2 to 20 atomic %.

21. The magnesium based alloy of claim 20, wherein the alloy includes 5 to 30 volume % of the precipitates.

* * * * *